United States Patent [19]

Müllritter et al.

[11] Patent Number: 4,515,356

[45] Date of Patent: May 7, 1985

[54] SPRING BIASED CRANK ARM DRIVE FOR TRAY MOUNTED STAPLER

[75] Inventors: Ludwig Müllritter, Munich; Günther Schnall, Eching; Franz Fruth, Germering, all of Fed. Rep. of Germany

[73] Assignee: Agfa-Gevaert Aktiengesellschaft, Leverkusen, Fed. Rep. of Germany

[21] Appl. No.: 576,531

[22] Filed: Feb. 2, 1984

[30] Foreign Application Priority Data

Feb. 12, 1983 [DE] Fed. Rep. of Germany ..... 3304875

[51] Int. Cl.[3] ..... B42B 1/02

[52] U.S. Cl. ..... 270/53; 227/3; 227/134

[58] Field of Search ..... 270/53, 58; 227/2–6, 227/39–42, 90, 110, 120, 124–134, 1

[56] References Cited

U.S. PATENT DOCUMENTS

| | | | |
|---|---|---|---|
| 621,748 | 3/1899 | Bucholz | 227/134 |
| 2,651,036 | 9/1953 | Stilwell | 227/5 |
| 2,885,680 | 5/1959 | Harrison | 227/3 |
| 3,065,470 | 11/1962 | Schmidt | 227/134 |
| 3,305,154 | 2/1967 | McCain et al. | 227/2 |
| 3,622,061 | 11/1971 | Hoyer | 227/131 X |
| 3,747,824 | 7/1973 | Linden | 227/3 |
| 4,083,550 | 4/1978 | Pal | 270/53 |
| 4,270,742 | 6/1981 | Kobayashi | 270/53 |

FOREIGN PATENT DOCUMENTS

| | | | |
|---|---|---|---|
| 1146476 | 4/1957 | Fed. Rep. of Germany | 227/129 |
| 1270409 | 4/1972 | United Kingdom | 270/53 |

OTHER PUBLICATIONS

"Staple Unloader for Copier", IBM Technical Disclosure Bulletin, vol. 18, No. 9, Feb. 1976, p. 2807.

*Primary Examiner*—E. H. Eickholt

*Attorney, Agent, or Firm*—Michael J. Striker

[57] ABSTRACT

In a copying machine a copy-receiving device is provided which includes a table with a plate inclined to a horizontal at a predetermined angle and supporting thereon sets of copies or sheets to be stapled together by a stapling device which is insertable into the copy-receiving device and arranged at the lower end of the inclined plate. The stapling device is actuated by a drive motor, a crank drive with a pulling bar having an end portion with a compression spring thereon, and an actuating arm pivotally connected to the end portion of the pulling bar. The spring compensates for various thickness is of the stacks of sheets being stapled and provides for displacement-free stapling of the sheets.

6 Claims, 5 Drawing Figures

SPRING BIASED CRANK ARM DRIVE FOR TRAY MOUNTED STAPLER

BACKGROUND OF THE INVENTION

The present invention relates to copy-receiving arrangements utilized in conjunction with copying machines to sort out sets of copies continuously discharged from the copying machine.

The copy-receiving device normally includes a copy-receiving table which has a surface on which sets of copies discharged from the copying machine are collected. This surface is usually inclined at a predetermined angle to a horizontal. A commercially available stapling device can be inserted into the housing of the table, which device may be driven by a motor-driven crank. Such a device is disclosed, for example in German patent application No. P 3,234,746.4 of Sept. 20, 1982.

SUMMARY OF THE INVENTION

It is an object of the present invention to provide an improved sorting device for a copying machine.

It is a further object of the invention to provide improved means for actuating the stapling device, which would render possible a control of the movement of the stapling device and also an independent adjustment of the device to various thicknesses of the sets or stack of sheets being stapled. Thereby, the actuating means of the stapler must first slowly connect the stapling elements under the corresponding compression of the sheets or copies in the set. Due to a slow compression the displacement of individual sheets in the set relative to each other, normally occuring with a fast compression because of air cushions between the sheets, are prevented. After the air disposed between individual sheets escapes the usual stapling process is carried out in a fast and powerful fashion to obtain a reliable connection of the sheets in the set in the correct direction.

These and other objects of the invention are attained by a copy-receiving device for receiving copies in a copying machine, comprising a copy-receiving table connected to the copying machine and receiving therefrom a continuous succession of copies and including a copy-receiving plate on which sets of copies to be stapled are collected, said plate being inclined to a horizontal at a predetermined angle; a stapling device insertable into said table to staple the sheets in the set on said plate together; and means for actuating said stapling device, said actuating means comprising a drive motor, a crank drive connected to said motor, spring means on said crank drive, and an actuating arm cooperating with the stapling device to actuate the latter, said motor driving said actuating arm via said crank drive under the imposition of said spring means.

The device may further include a microswitch cooperating with said crank drive for switching said drive motor off when the crank drive is in a termination position.

The spring means may be a compression spring.

The crank drive may include a crank disc, a crank pin, and an elongated pulling bar, said bar being pivotally connected to said disc by said crank pin. The actuating arm may have an end and be formed at said end with a bulge-like projection.

The pulling bar may have a pin outwardly radially projecting therefrom, said projection resting on said pin under the action of the spring.

The pulling bar may have an end portion carrying said compression spring and provided with a circlip holding said spring on said end portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
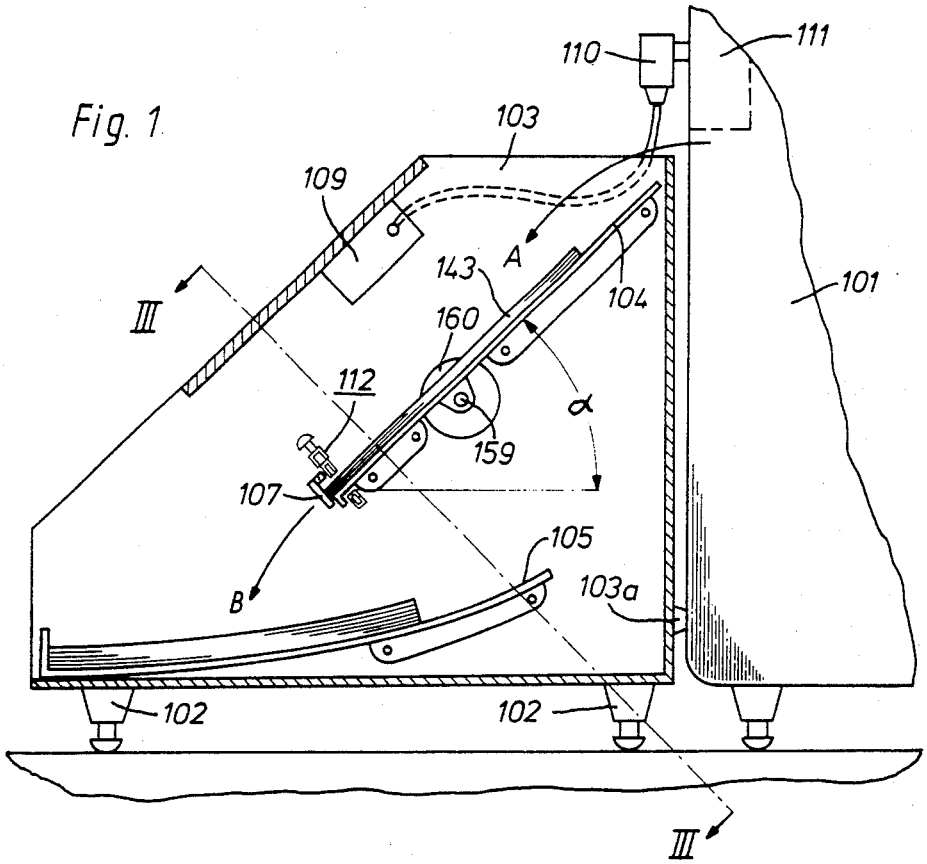
FIG. 1 is a sectional view taken along line I—I of FIG. 2.

Referring now to the drawings in detail, FIG. 1 shows a side sectional view of the copy-receiving table 103 connected to a copying machine 101. Copy-receiving table 103 as well as the copying machine 101 are provided with feet 102. The copy-receiving table 103 has centering projections 103*a* engaged in respective recesses of the housing of the copying machine for centering table 103 relative to the copying machine. Two copy-supporting plates 104 and 105 are arranged between the side walls of table 103. The first copy-supporting plate 104 is inclined in the direction A of the transport of copies discharged from the copying machine, the angle of inclination $\alpha$ to a horizontal is so great that copies fall under gravity onto the surface of plate 104 and are collected against a stop flap 107.

After moving the stop flap 107 to the open position a set of copies collected on the plate 104 drops under gravity in the direction of arrow B onto the second copy-receiving plate 105 which is positioned below plate 104. The copy-receiving table 103 has a control device 109 which is connected to a central control device 111 of the copying machine by means of a multiple contact plug 110.

Figure 3:
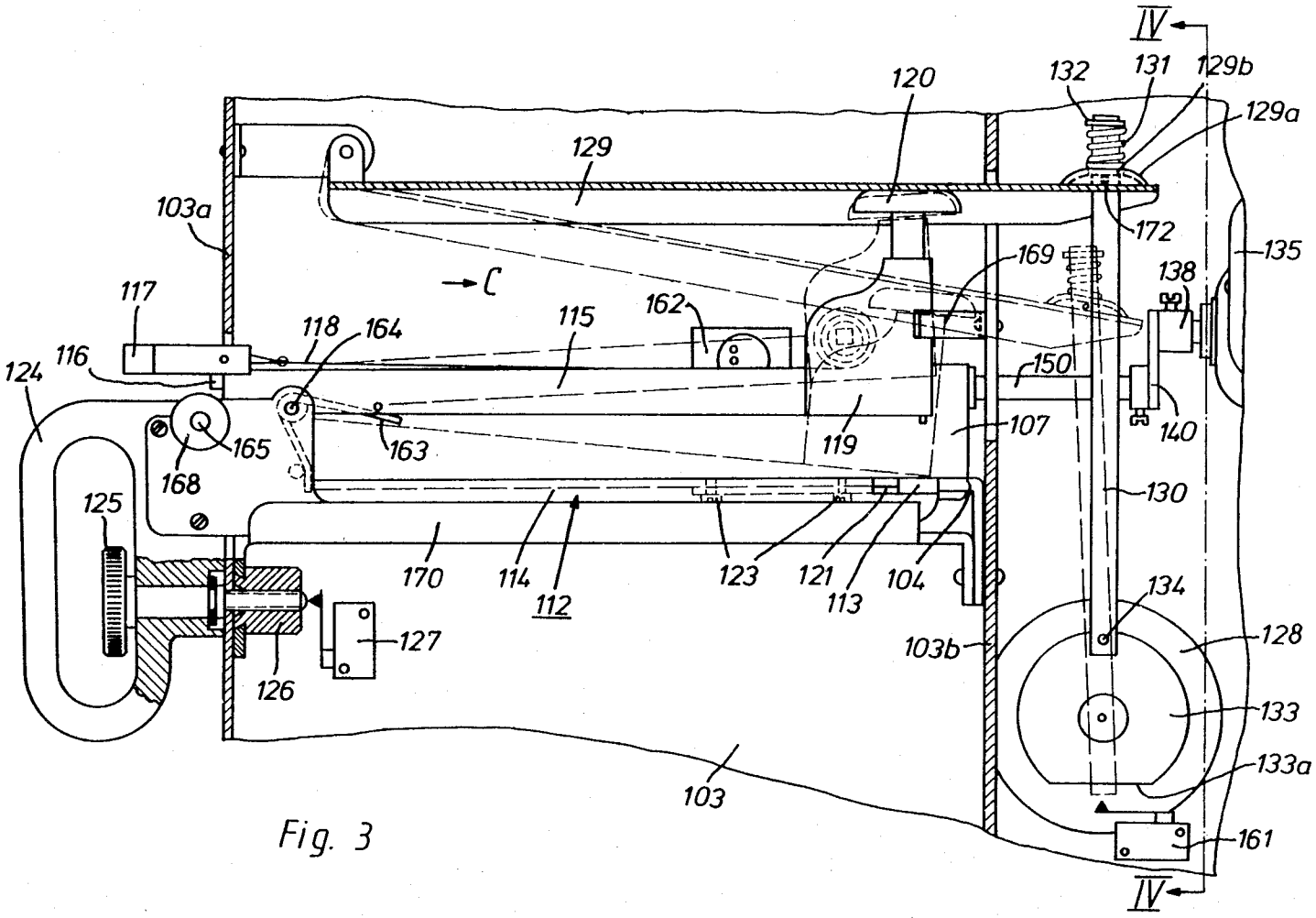
FIG. 3 is a sectional view taken along line III—III of FIG. 1.
Figure 5:
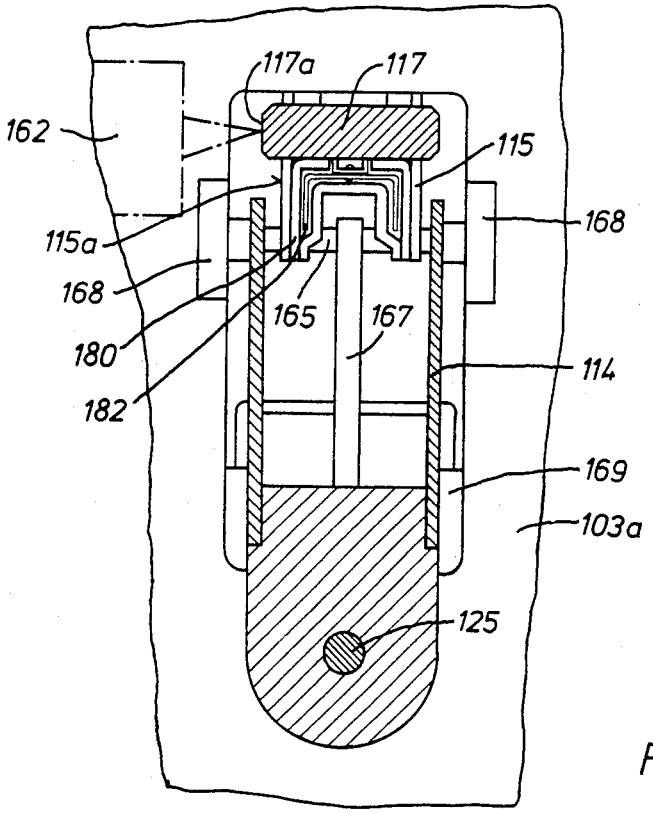
FIG. 5 is a sectional view taken along line V—V of FIG. 4.

FIG. 3 illustrates in detail a stapling device 112 also seen in FIG. 1, this device being arranged on the upper copy-receiving plate 104. The stapling arrangement for stapling sheets together is a commercially available stapler. This stapler is comprised of a stationary lower portion 114 provided with an anvil 113 and an upper pivotable arm 115 pivotally connected to portion 114 on a pivot axle 164. A clip supply box 180 accommodating clips 182 is disposed in U-shaped upper portion 115 as shown in FIG. 5. Stapling clips are transported from the supply box towards a stapling position by means of a slide 116 slidably insertable in clip supply box 180. A pivotable hand grip 117 is arranged on the slide 116. A coil spring 118 is secured to the hand grip 117, this coil spring being wound about a shaft in the usual manner;

the wound up portion of spring 118 is disposed in a housing 119 mounted on the pivotable arm 115 and thereby a pulling force continually acting on slide 116 in the direction of arrow C is exerted on slide 116. An actuation knob 120 positioned in housing 119 serves for actuating the stapling device 112.

In order to ensure an unobjectionable cooperation of the upper portion 115 with anvil 113 the latter is arranged on a carrier 121 which is displaceable in lower portion 114 lengthwise thereof. Position screws 123 serve for securing carrier 121 in position.

In addition, a U-shaped laterally adjustable guide element 169 is mounted on a side wall or plate **103*b* of copy-receiving table 103; guide element 169 embraces housing 119 mounted on the upper arm 115 when the stapling device 112 is inserted in the copying machine and thereby the lateral displacement of arm 115 relative to the lower portion 114, confined in a U-shaped guide rail 170, extended between an outer wall 103*a* and side wall 103*b***, is prevented.

The clip supply box 180, in which a plurality of clips 182 are disposed in succession, is enclosed by U-shaped upper portion 115 of the stapling device 112.

The stapling device 112 is provided at the end thereof extending beyond the table 103 with a hand grip 124 which serves for gripping the stapling device during the insertion thereof into the U-shaped guide rail 170 of the copy-receiving table 103. A screw 125 provided with a knurled knob is mounted in the hand grip 124, this screw being screwed into a bushing 126 secured to table 103 when the stapling device 112 is inserted into the table. A microswitch 127 cooperating with the screw 125 sends to the aforementioned control device 109 of the table 103, a signal indicating whether the stapling device 112 is correctly inserted into guide rail 170 of the copy-receiving table 103 and whether this device is correctly secured to table 103. As far as microswitch 127 has no contact with the end of screw 125 the drive motor 128 for actuating the stapling device 112 remains switched off.

A pivoting arm 129 which passes through the side wall **103*b* of the copy-receiving table 103 serves for actuating the stapling device 112. When the latter is properly inserted into the guide rail 170 the actuation knob 120 of the stapling device is in engagement with the pivotable arm 129 under the influence of a lever spring 163 acting between the lower portion 114 and upper portion or arm 115. The pivotable arm 129 is driven by means of a pulling bar 130 which is hingedly connected to pivotable arm 129 with the interposition of a compression spring 131. Pivotable arm 129 has a somewhat ball-shaped projection or bulge 129*a*, the inner surface of which, under the action of compression spring 131, rests against a pin 172 radially projecting through the pulling bar 130. Compression spring 131 is secured to the end portion of the pulling bar 130, extended through an opening 129*b* in bulge 129*a*, by means of a circlip 132**.

Due to the above described arrangement the pulling bar 130 can execute a pivoting motion which is required to follow the movement of a crank pin 134 connected to a rotary crank disc 133 which is driven by a drive motor 128, the pulling bar 130 at the lower end thereof being pivotally connected to the crank pin 134. On the other hand, the pulling bar 130 can also move further in the pulling direction against the action of compression spring 131 when the movement of the pivotable arm or lever 129 is braked or stopped due to the resistance of the stapling device 112. This is the situation when an actual stapling process must start after a set of copies to be stapled has been compressed. At this moment an increased resistance occurs on the stapling device unless the spikes of stapling clips penetrate the upper surface of the uppermost sheet in the set of copies to be stapled. The penetration of the clips through the copies in the set follows when the compression spring 131, insignificantly prestressed during the assembling, is sufficiently stressed upon a further movement of the pulling bar 130 so as to overcome the resistance to penetration by the clips. Since this resistance to penetration of the clips through the copies compressed in the set is greater than the force required for a subsequent further movement and bending of stapling clips, the further stapling process is completed when the compression spring 131 is partially relaxed so that a mutual displacement of the sheets to be stapled or an imperfect bending of the clips are prevented from occurrence during the actual stapling process.

The compression spring 131 also serves for compensation for various thicknesses of sets of copies 143 located on the copy-receiving plate 104.

After one full rotation of the crank disc 133 the microswitch 161 switches the drive motor 128 into inoperative position unless a new signal is received from the central control unit 111 of the copying machine 101. The microswitch 161 cooperates with a surface **133*a* provided on the crank disc 133**.

A further drive motor 135 is provided on the device according to the invention for actuating the stop flap 107, this drive motor effecting the movement of flap 107 between a closed position and an open position by means of a crank guide 140 interconnected between a bar 150 secured to flap 107 and a suitable transmission 138 connected to the outlet shaft of drive motor 135.

A jog-like motion of the copy-receiving plate 104 with the copy set 143 positioned thereon, before the stapling process starts is obtained by means of a circular disc 160 (FIGS. 1 and 2) rotatably and lengthwise-displaceably positioned on a reciprocating guide bar 159. The reciprocating movement of guide bar 159 is produced by means of the crank drive not shown herein. The disc 160 cooperating with guide bar 159 actuated by the crank drive serves for aligning the sheets of the stack in a gentle fashion and over a substantially large region of the sheet format.

Figure 2:
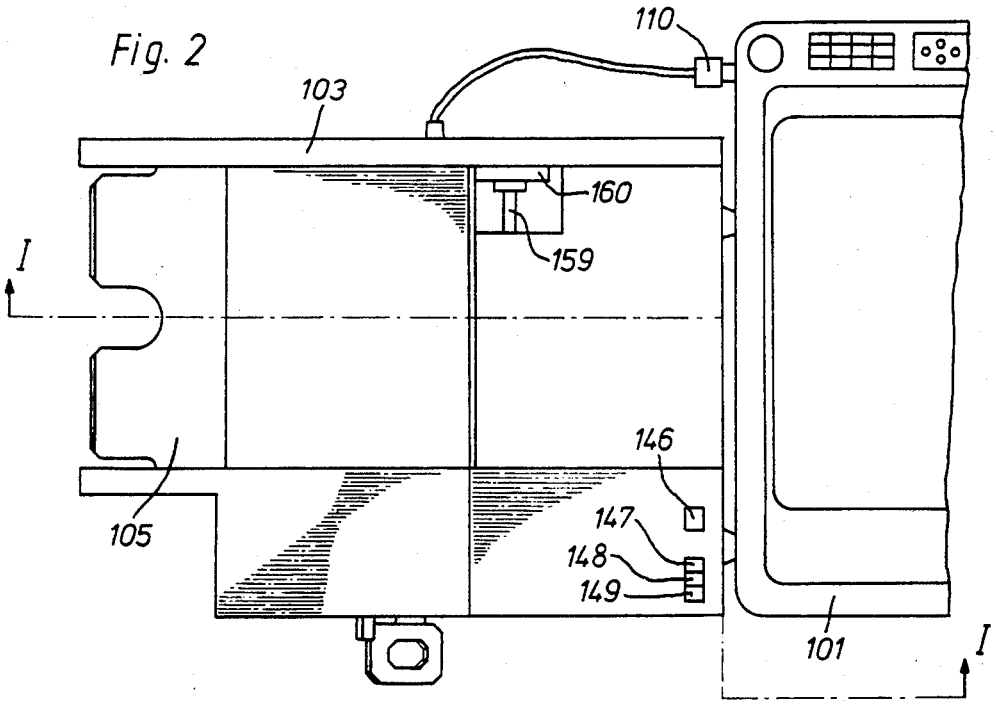
FIG. 2 is a top plan view of the copy-receiving table according to the invention in conjunction with a copying machine partially illustrated in the drawing.

Reference characters 147, 148 and 149 in FIG. 2 denote control lamps for indicating various operation conditions or malfunctions of the device, for example the open position of flaps 107, the exceeding of an allowed thickness of the set of copies, the exhaustion of the clips in the clip supply device or the like.

Figure 4:
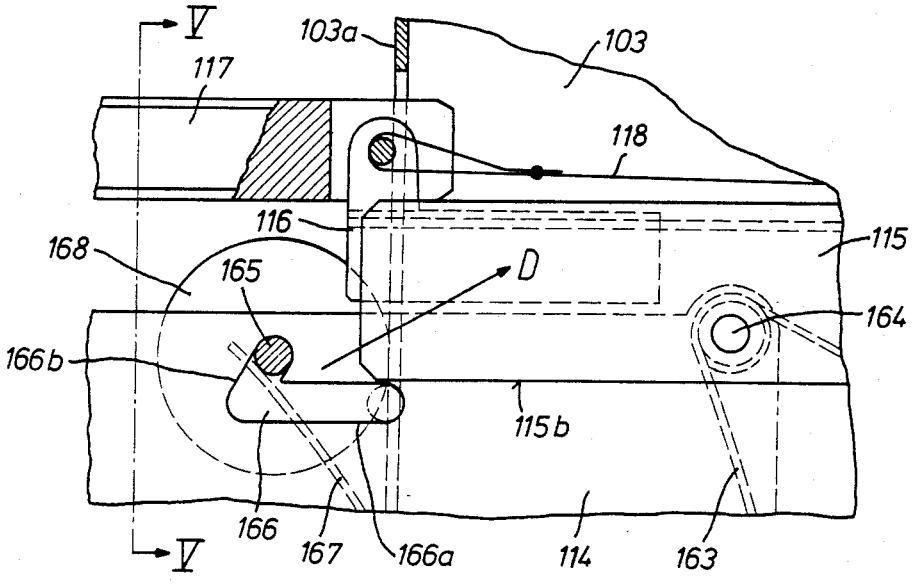
FIG. 4 is a segment of FIG. 3 indicated by arrow IV in FIG. 3.

With reference to FIGS. 4 and 5 it will be seen that a reflection light barrier 162 is arranged in the housing enclosing the copy-receiving table 103, which light barrier serves the purpose of indicating the clip shortage in the clip supply box 180. Reflection light barrier 162, which is arranged near the end of handle 117 and at the end of the path of slide 116, cooperates with a reflected surface **117*a* provided on the handle 117 shown in FIG. 5. In operation reflection light barrier 162 sends a signal to the control unit 109 of copy-receiving table 103, indicating the exhaust of clips 182 in box 180. The absence of the clips in the box 180 is indicated by a control lamp 147 mounted on the upper side of the copy-receiving table 103. Lamp 147 is seen in FIG. 2. In addition, control unit 109 shuts off drive motor 128** of the stapling device.

With reference to FIG. 3 it can be seen that the actuation of the stapling device is caused by pressing down of the actuation knob 120 which is biased in the initial position by a return spring not shown herein. The actuation knob, which is under the influence of lever spring 163 disposed between the upper portion 115 and lower portion 114 of the stapling device, is engaged with the actuation arm 129 when the stapling device 112 is inserted into the copy-receiving table 103. In the case of jamming of the stapling device the activation knob 120 is not able to return into the initial or output position, whereby, when the pivoting arm 129 is moved up, portion 115 of the stapling device is pivoted into the position shown in FIG. 3 by a broken line. The reflected side surface 115*a* of upper portion 115 as shown in FIG. 5, thus is moved into the area of action of reflection light barrier 162 which also senses a jamming of the stapling device. This malfunction is eventually indicated by control lamp 147 whereby drive motor 128 of the stapling device is switched off. Further control lamps 148 and 149 indicate an open position of flap 107 and also the position of the stack when the allowable thickness of the stack of copies disposed on plate 104 is exceeded.

The upper portion or arm 115 of the stapling device can reach this extreme open position shown by broken line in FIG. 3 only in the case of malfunction occurred within the device, the manipulation of the stapling device from outside would be in this position unnecessarily difficult. To avoid this a locking device shown in FIGS. 4 and 5 and arranged between the lower portion 114 and upper portion 115 of the stapling device is switched on. This locking device includes a locking pin 165 extending through the lower portion 114 and guided in a guiding slot 166 formed in lower portion 114. The guiding slot 166 is fork-shaped and has a first portion 166*a* parallel to the elongation of lower portion 114 and a second portion 166*b* which extends transversally to portion 166*a*. A leaf spring 167 urges locking pin 165 to move in the direction of arrow D; the locking pin 165 with the aid of one of actuation knobs 168 mounted at the opposite ends of the pin 165 and rigidly connected thereto can be selectively inserted in one of two slot portions 166*a* or 166*b*.

When the locking pin 165 is inserted into slot portion 166*a*, this pin becomes engaged with a stop surface 115*b* of the upper portion 115 pivotable on the pivot axis 164 of the lower portion 114 and thus prevents a higher pivoting of that upper portion under the action of lever spring 163. When the stapling device 112 is inserted into copy-receiving table 103 the actuation knobs 168 of the locking device come into engagement with the outer side wall 103*a* of the copy-receiving table 103. The locking pin 165 is then pulled out from slot portion 166*a* against the force of spring 167 and is guided into slot portion 166*b*. In this position of locking pin 165 the stapling device 112 remains open from the outside of the device whereby the elimination of defects occurred in the device is facilitated.

It will be understood that each of the elements described above, or two or more together, may also find a useful application in other types of copy-receiving devices differing from the types described above.

While the invention has been illustrated and described as embodied in a copy-receiving device of a copying machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A copy-receiving device for receiving copies in a copying machine, comprising a copy-receiving table connected to the copying machine and receiving therefrom a continuous succession of copies and including at least one copy-receiving plate on which sets of copies to be stapled are collected, said plate being inclined to a horizontal at a predetermined angle; a stapling device insertable into said table to staple the copies in the set on said plate together; means for actuating said stapling device, said actuating means comprising a drive motor, a crank drive connected to said motor, a compression spring on said crank drive, and an actuating arm cooperating with the stapling device to actuate the latter, said motor driving said actuating arm via said crank drive under the interposition of said compression spring; and a microswitch cooperating with said crank drive for switching said drive motor off when the crank drive is in a termination position, said crank drive including a crank disc, a crank pin, and an elongated pulling bar, said bar being pivotally connected to said disc by said crank pin, said actuating arm having an end and being formed at said end with a bulge-like projection.

2. The copy-receiving device as defined in claim 1, wherein said pulling bar has a pin outwardly radially projecting therefrom, said projection resting on said pin under the action of said spring.

3. The copy-receiving device as defined in claim 2, wherein said bar has an end portion carrying said compression spring and provided with a circlip holding said spring on said end portion.

4. The copy-receiving device as defined in claim 3, further including rail means for receiving said stapling device.

5. The device as defined in claim 4, wherein said stapling device includes a stationary lower portion and a pivotal upper portion adapted to pivot relative to the lower portion between a closed and open position, said actuating arm cooperating with said upper portion.

6. A copy-receiving device for receiving copies in a copying machine, comprising a copy-receiving table connected to the copying machine and receiving therefrom a continuous succession of copies and including at least one copy-receiving plate on which sets of copies to be stapled are collected, said plate being inclined to a horizontal at a predetermined angle; a stapling device insertable into said table to staple the copies in the set on said plate together; and means for actuating said stapling device, said actuating means comprising a drive motor, a crank drive connected to said motor and including a crank disc, a crank pin, and an elongated pulling bar pivotally connected to said disc by said crank pin and having an end portion, an actuating arm cooperating with the stapling device at one end thereof to actuate the stapling device and pivotally connected to said pulling bar at an opposite end thereof, and a compression spring mounted on said end portion and directly biasing said actuating arm at said opposite end thereof so that said motor drives said actuating arm via the pulling bar of said crank drive under the interposition of said compression spring.

* * * * *